United States Patent [19]

Shimizu et al.

[11] 4,030,051

[45] June 14, 1977

[54] N-SECTION MICROWAVE RESONATOR HAVING ROTARY JOINT FOR VARIABLE COUPLING

[75] Inventors: James K. Shimizu, Palos Verdes Estates; Richard V. Basil, Jr., Canoga Park, both of Calif.

[73] Assignee: Hughes Aircraft Company, Culver City, Calif.

[22] Filed: July 6, 1976

[21] Appl. No.: 702,796

[52] U.S. Cl. ..... 333/83 R; 333/98 TN

[51] Int. Cl.² ..... H01P 5/04; H01P 7/06

[58] Field of Search ..... 333/73 W, 83 R, 98 TN

[56] References Cited

UNITED STATES PATENTS

| | | | |
|---|---|---|---|
| 2,513,205 | 6/1950 | Roberts | 333/83 R X |
| 3,697,898 | 10/1972 | Blachier et al. | 333/73 W X |

*Primary Examiner*—Paul L. Gensler

*Attorney, Agent, or Firm*—John Holtrichter, Jr.; W. H. MacAllister

[57] ABSTRACT

A microwave resonator operating in the $TE_{11}$ circular mode with a pair of iris plates defining the resonator, each iris including an elliptical aperture centrally disposed therein, the resonator having a rotary joint midway between the irises at the location of a current null so that the two half portions of the resonator may be rotated with respect to each other in order to provide a desired relative iris axis alignment for an infinitely variable coupling value between a minimum value determined by the minor axis dimension of the elliptical apertures and a maximum value determined by the major axis dimension thereof.

9 Claims, 5 Drawing Figures

Fig. 1.
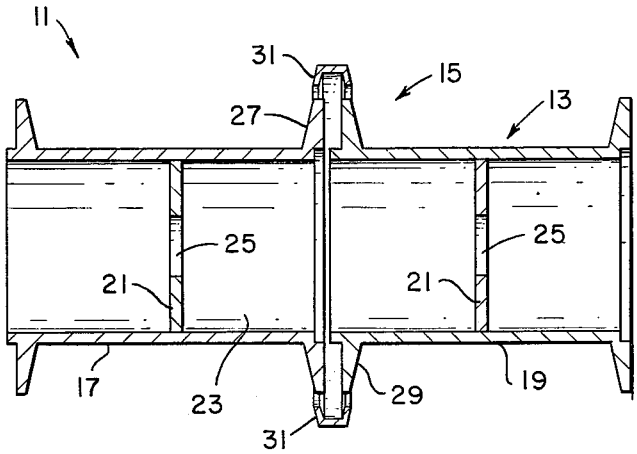
Fig. 2.
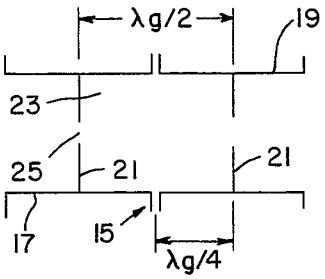
Fig. 4.
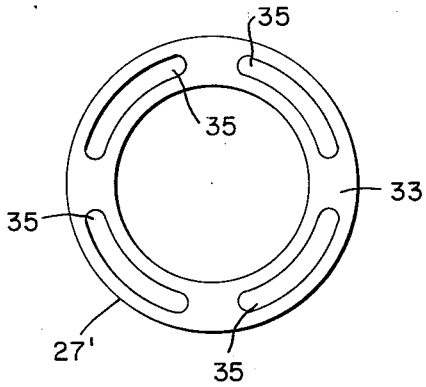
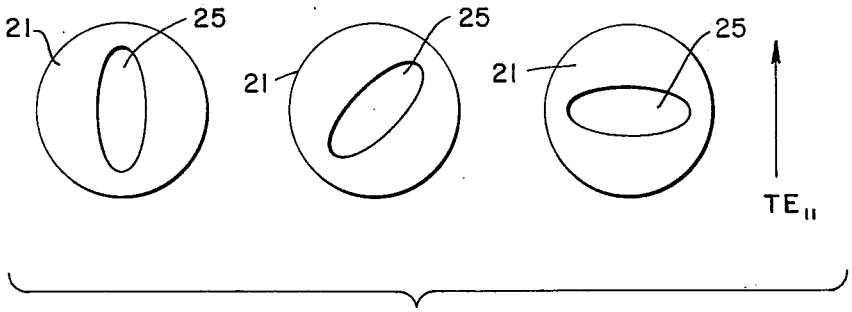
Fig. 3.

N-SECTION MICROWAVE RESONATOR HAVING ROTARY JOINT FOR VARIABLE COUPLING

BACKGROUND OF THE INVENTION

The background of the invention will be set forth in two parts.

1. Field of the Invention

This invention relates generally to microwave resonators and more particularly to N-section microwave resonators with variable coupling.

1. Description of the Prior Art

In microwave resonators and filters with exact performance requirements, it is desirable to employ tuning adjustments to alleviate the need for unreasonable fabrication tolerances. In rectangular waveguide filters, the coupling between filter cavities is made adjustable by the use of a tuning screw in the plane of the coupling iris. However, in coupled high Q, cylindrical cavity resonators, the iris plates are relatively thin in comparison to the diameter of a tuning screw, which makes the use of such screws impractical.

When operating a resonator in the $TE_{11}$ circular mode, the coupling between resonators is provided by apertures in the iris plates, and the aperture size varies along the length of the resonator. The size of the aperture depends upon the reactance necessary to provide the required rf bandwidth, while the reactance is related to the ratio of the thickness, $t$, of the iris wall and $d$, the aperture opening. It has been found that because of manufacturing tolerances of both $d$ and $t$, some variable means is needed to provide the required electrical performance of the components at microwave frequencies.

Generally, for accuracy and convenience, the aperture openings have been in the form of a circular hole centered in the iris plate. For the first approximation, if $t$ remains constant, then the reactance or coupling between cavities depends upon the width of the hole with respect to the propagating $TE_{11}$ mode. In a resonant cavity of $\lambda g/2$ in length, current density is high at the aperture location, while a minimum occurs at $\lambda g/4$ from the aperture location. This is at the midpoint of the resonator.

Even where the iris plates are thick enough to accommodate tuning screws in order to provide variable coupling, the insertion of the screw into the aperture increases coupling, but at the expense of increasing the insertion loss of the final resonator assembly.

In contradistinction to the prior art, in the present invention the resonator is constructed with a rotary joint between the iris plates at the midpoint of the resonator, and the apertures in the plates are in the form of ellipses whereby the coupling into and out of the resonator may be accurately varied simply by rotating the portion of the waveguide on opposite sides of the rotating joint with respect to each other. In this manner, both over and under coupling values are obtained, the range only depending upon the dimensions of the major and minor axes of the ellipses.

In the case of an N-section resonator, normally, the coupling aperture opening is large for the end resonator and smallest at the midsection. Therefore, if the major and minor ellipse openings are selected from the maximum and minimum aperture dimensions required for a given N-section resonator to provide a given electrical characteristic, all that is required in the invention is to provide identical elliptical shape apertures for all sections and be able to rotate the portions of each section on opposite sides of the rotating joint 90° to obtain infinitely variable coupling values as determined by the maximum and minimum aperture sizes.

SUMMARY OF THE INVENTION

In view of the foregoing factors and conditions characteristic of the prior art, it is a primary object of the present invention to provide an improved microwave resonator assembly with variable coupling.

Another object of the present invention is to provide a tunable microwave resonator assembly which obviates the necessity of maintaining high manufacturing tolerances.

Still another object of the present invention is to provide a simple yet effective N-section microwave resonator assembly with variable coupling between tandem resonators, with a minimum or no added rf loss.

Yet another object of the present invention is to provide an N-section microwave resonator assembly where, by rotating adjacent sections of waveguide with respect to each other by 90°, there is obtained an infinitely variable coupling value between a predetermined maximum and mimimum value.

In accordance with one embodiment of the present invention, a microwave resonator is provided exhibiting an infinitely variable coupling value over a relatively broad coupling range. It includes a cylindrical waveguide section having a rotating joint disposed therein and a pair of spaced iris plates transversely disposed in the waveguide section defining a resonant cavity section therebetween which has a relatively low current density location approximately midway between the iris plates. The rotating joint is disposed in the relatively low current density location, and the iris plates have centrally disposed elliptical apertures whereby a desired axis relationship between the elliptical apertures is obtained by rotating the iris plates with respect to each other.

The invention is preferably implemented in the form of an N-section microwave resonator having iris plates defining tandemly disposed resonant cavities with a rotating joint located at the relatively low current density location with each of the resonant cavities. The elliptical apertures in the iris plates are preferably identical with respect to their major and minor axes so that the minimum coupling is determined by the minor axis dimension of the elliptical apertures and the maximum coupling is determined by the dimension of the major axis.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings, in which like reference characters refer to like elements in the several views.

BRIEF DESCRIPTION OF THE DRAWINGS

FIG. 1 is an elevational view, in section, of a microwave resonator constructed in accordance with the present invention;

FIG. 2 is a schematic representation of the resonator of FIG. 1;

FIG. 3 illustrates how elliptical aperture orientation with respect to an E-field affects coupling;

FIG. 4 is an elevational view of an alternate flange arrangement that may be utilized at the rotatable joints of the invention.

DESCRIPTION OF THE PREFERRED EMBODIMENTS

Figure 5:
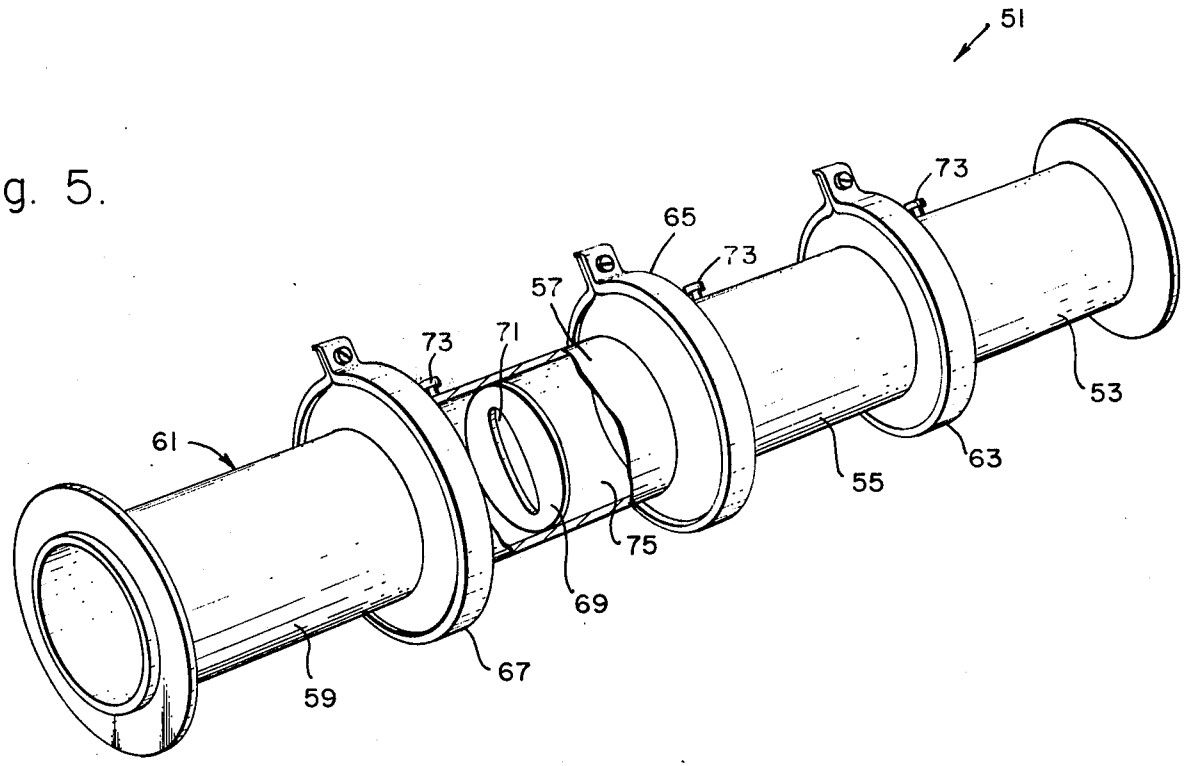
FIG. 5 is a perspective view of an N-section microwave resonator in accordance with a presently preferred embodiment of the invention.

Referring now to the drawing and more particularly to FIG. 1, there is shown a microwave resonator 11 for providing an infinitely variable coupling value over a relatively broad coupling range. The resonator 11 includes a cylindrical waveguide section 13 having a rotatable joint 15 dividing the waveguide section 13 into two portions 17 and 19 of equal length.

A pair of iris plates 21 are disposed within each of the two waveguide portions in planes perpendicular to the longitudinal axis of the waveguide section 13 as to define the length of a resonant cavity section 23. As seen schematically in FIG. 2, the length of the cavity section 23 is $\lambda g/2$, where $\lambda$ is free space and g is the velocity factor for this type of waveguide. This figure also shows that the rotatable joint 15 is located at $\lambda g/4$. In this type of resonant cavity, the maximum current densities occur in the vicinity of the iris plates 21, while a current null exists midway between the irises, namely $\lambda g/4$ from either iris plate. The location of the rotatable joint at this position avoids $I^2R$ electrical losses to a great extent.

Implementation of the variable coupling technique in accordance with the invention is accomplished by providing a basic elliptical iris aperture 25 in each iris plate 21 (cavity end wall). The elliptical apertures may be punched, machined or burned (electrical discharge machining) through the plates 21. Any desired coupling, between maximum and minimum design values, may then be obtained by merely rotating one of the waveguide portions with respect to the other portion. This relative rotation provides a variable, relative axis relationship between the elliptical apertures defining the cavity section 23. As is well known in the microwave art, the minimum coupling through an elliptical iris aperture is governed by the dimension of the minor axis of the ellipse (relative to an E field) and the major axis thereof determines the maximum coupling possible. Thus, by rotating the portions 17 and 19 so that the major axes of the two iris elliptical apertures defining the cavity section 23 are orthogonal to each other, a minimum coupling value is obtained. Relative rotation of the portions will gradually increase coupling to a maximum value when the major axes are in the same plane with each other and the E field, as illustrated in FIG. 3.

The rotatable joint 15 of FIG. 1 includes flanges 27 and 29 on opposite portions 17 and 19 of waveguide 13 which flanges are held together in a relative loose relationship to allow relative rotation of the two abutting portions of waveguide 13 by a marmon clamp 31, and which flanges may be tightly held by the clamp 31, through the use of a conventional tightening means (not shown) in order to prevent such relative rotation once a desired coupling is achieved. The two portions of waveguide section may be keyed or sleeved together to allow coaxial rotation of the cavity halves. Means other than marmon clamps may be used to hold the sections in a rotatable relationship. For example, the flange faces 33 may include curved slots 35 (illustrated in FIG. 4) to allow relative waveguide portion rotation of up to 90°. In this case the flanges may be held together by machine screws and nuts (not shown) in a conventional manner.

Referring now to FIG. 5, there is shown an N-section microwave resonator 51, representing a presently preferred embodiment of the invention. Here, portions 53, 55, 57 and 59 of a waveguide section 61 are mechanically coupled together by means of respective rotatable joints 63, 65 and 67, all similar to the rotatable joint 15 described previously. As in the first described embodiment, in each portion 53–59 is disposed an iris plate 69 including a basic elliptical aperture 71. Conventional tuning screws 73 are mounted immediately adjacent each joint to tune the resonance frequency of each cavity section 75. This practice is well known in the art and will not be described in detail here.

Normally, for a given N-section resonator, the coupling aperture dimension is large for the end resonator and smallest at the midsection. Therefore, if the major and minor dimensions of identical elliptical apertures are selected from the maximum and minimum aperture required for a given N-section resonator to provide a given electrical performance, an infinitely variable coupling value between maximum and minimum aperture size is obtained by relative rotation of adjacent portions of the waveguide section by 90°.

It should be evident from the foregoing that a novel and advantageous microwave resonator arrangement has been described that is simple and inexpensive to fabricate and which provides an infinitely variable coupling value.

It should also be understood that the materials and processes described in fabricating the various embodiments of the invention are not critical, and that any material or process exhibiting similar desired characteristics and structures may be utilized.

Although the present invention has been shown and described with reference to particular embodiments, nevertheless various changes, modifications and additional embodiments which are obvious to persons skilled in the art to which the invention pertains are deemed to lie within the spirit, scope and comtemplation of the invention.

What is claimed is:

1. A microwave resonator for providing an infinitely variable coupling value over a relatively broad coupling range, comprising:
   - a cylindrical waveguide section having a rotating joint disposed therein;
   - a pair of spaced iris plates transversely disposed in said waveguide section and defining a resonant cavity section therebetween having a relatively low current density location approximately midway between said iris plates, said rotating joint being disposed in said relatively low current density location, said iris plates having centrally disposed elliptical apertures and, said iris plates being rotatable with respect to each other to provide a desired axis relationship between said elliptical apertures.

2. The resonator according to claim 1, wherein said waveguide section includes first and second portions rotatably coupled together by said rotating joint, each of said portions fixedly carrying a different one of said iris plates.

3. The resonator according to claim 1, wherein said rotating joint includes a carrier portion and a tuning screw mounted in said carrier portion and extending into said resonant cavity an adjustable amount.

4. The resonator to claim 1, wherein the axial length of said resonant cavity is approximately $\lambda g/2$, and wherein said rotating joint is located approximately $\lambda g/4$ from one of said iris plates where $\lambda$ is the wavelength in free space and g is the velocity factor for this type of waveguide section

5. The resonator according to claim 2, where in said rotating joint includes clamping means for allowing relative rotation of said iris plates before being moved to a locked configuration to prevent such rotation.

6. The resonator according to claim 5, wherein each of the ends of said portions includes outwardly extending flanges, and wherein said clamping means includes a marmon clamp mounted over adjacent ones of said flanges.

7. The resonator according to claim 5, wherein each of the ends of said portions includes outwardly extending flanges at least one of which having screw-accommodating curved elongated slots therethrough adapted to allow limited relative rotation of adjacent ones of said portions.

8. The resonator according to claim 1, wherein each of said elliptical apertures have the same major and minor axis dimensions.

9. An N-section microwave resonator for providing an infinitely variable coupling value over a relatively broad coupling range, comprising:

a cylindrical waveguide having more than one coaxial resonant cavity section therein and having a rotating joint disposed within each such section;

iris plates transversely disposed in said waveguide and defining said resonant cavity sections therebetween, each of said resonant cavity sections being dimensioned to have a relatively high current density at said iris plates and a relatively low current density location approximately midway between said iris plates, said rotating joints being disposed in said relatively low current density locations, said iris plates having elliptical apertures with essentially identical major axis lengths and essentially identical minor axis lengths, said resonant cavity sections being rotatable with respect to each other to provide a desired axial relationship of said elliptical apertures to provide a desired inter-cavity coupling.

* * * * *